United States Patent [19]

Clancy

[11] 3,978,636

[45] Sept. 7, 1976

[54] METHOD AND APPARATUS FOR THE PACKAGING OF MOIST ARTICLES

[75] Inventor: David Clancy, Canaan, Conn.

[73] Assignee: Colgate-Palmolive Company, New York, N.Y.

[22] Filed: Sept. 11, 1972

[21] Appl. No.: 287,735

[52] U.S. Cl. ..... 53/21 FW; 53/29; 53/120; 53/183; 53/239

[51] Int. Cl.[2] ..... B65B 9/2; B65B 25/00

[58] Field of Search ..... 53/21 FC, 21 FW, 28, 53/29, 36, 120, 117, 168, 180, 183, 239; 141/102, 103; 221/96

[56] References Cited

UNITED STATES PATENTS

| | | | |
|---|---|---|---|
| 2,666,565 | 1/1954 | Barnes et al. | 141/102 |
| 2,784,542 | 3/1957 | Stark | 53/239 |
| 3,402,523 | 9/1968 | Mojonnier | 53/267 X |
| 3,477,200 | 11/1969 | Weinberger et al. | 53/21 FC |

*Primary Examiner*—Robert L. Spruill
*Attorney, Agent, or Firm*—Strauch, Nolan, Neale, Nies & Kurz

[57] ABSTRACT

In the packaging of moist towelettes in sealed envelopes part of the liquid is inserted before the towellette is thrust into the envelope and the balance is subsequently injected.

8 Claims, 2 Drawing Figures

METHOD AND APPARATUS FOR THE PACKAGING OF MOIST ARTICLES

This invention relates to the packaging of moist, usually folded, articles such as towelettes in individual moisture proof envelopes, and is particularly concerned with a novel method and apparatus for improved and more efficient packaging.

More particularly in a preferred embodiment the invention specifically relates to the evaporation proof packaging of sheets of fibrous material impregnated or otherwise treated with a liquid that may have volatile components, which sheets are sealed in air tight envelopes so that the liquid is available for application in moist fresh condition by the user when he opens an envelope. The towelette sheet serves as an applicator pad for the liquid when the user opens the envelope.

The patent to Clancy U.s. Pat. No. 3,481,099 discloses a commercial practice of packaging moist towelettes for this purpose. In that patent individual envelopes are automatically formed from a web of moisture proof material and these envelopes while open at the top are fed in succession to a station where folded individual dry towelettes of moisture absorbent material are thrust into the envelope. Then the envelope is moved to a further station wherein a predetermined charge of liquid for moistening the inserted towelette is introduced into the envelope, and then the envelope is moved to a subsequent heat seal station wherein the envelope is sealed across the top to become air tight.

Problems have been encountered in the foregoing practice during the liquid filling stage in that often some of the measured charge of liquid sought to be introduced into the envelope may splash out of the envelope, with the result that insufficient liquid is contained in the sealed envelope. This means that the towelette may be incompletely moistened, or that there may not be enough liquid in the package to accomplish a desired treatment operation when the envelope is opened by the user.

This problem has been solved in the invention by the provision of a premoistening station wherein prior to insertion of the towelette or other article to serve as the carrier for the treatment liquid a small amount of the total liquid required for the package is injected into the open top empty envelope, and then after insertion of the article the balance of the required liquid is introduced. This arrangement has proved to be remarkably efficient in that the liquid introduced at the premoistening station not only wets the interior walls of the envelope to facilitate insertion of the folded towelette or other article but also the towelette has already absorbed most of the initial liquid charge with a wicking action before the balance of the liquid is introduced so that at the time of final sealing the towelette is usually fully impregnated and the package may be squeezed tighter during sealing without ejecting free liquid.

Since in the invention less liquid need be injected into the envelope after insertion of the towelette there is little or no loss of liquid due to its splashing out of the envelope. Since less time is needed to inject the balance of the liquid after insertion of the towelette than was required to inject the whole charge all at once, no appreciable added time is required for the overall packaging operation.

The major advantage of the invention is therefore efficient two stage injection of the liquid for treating or impregnating towelettes or other carrier articles to be packaged in moist condition. In more detail an advantage of the invention is that it provides in sequence partial injection of the required charge of liquid, insertion of the towelette to be impregnated and then injection of the required balance of the liquid.

PREFERRED EMBODIMENTS

Figure 1:
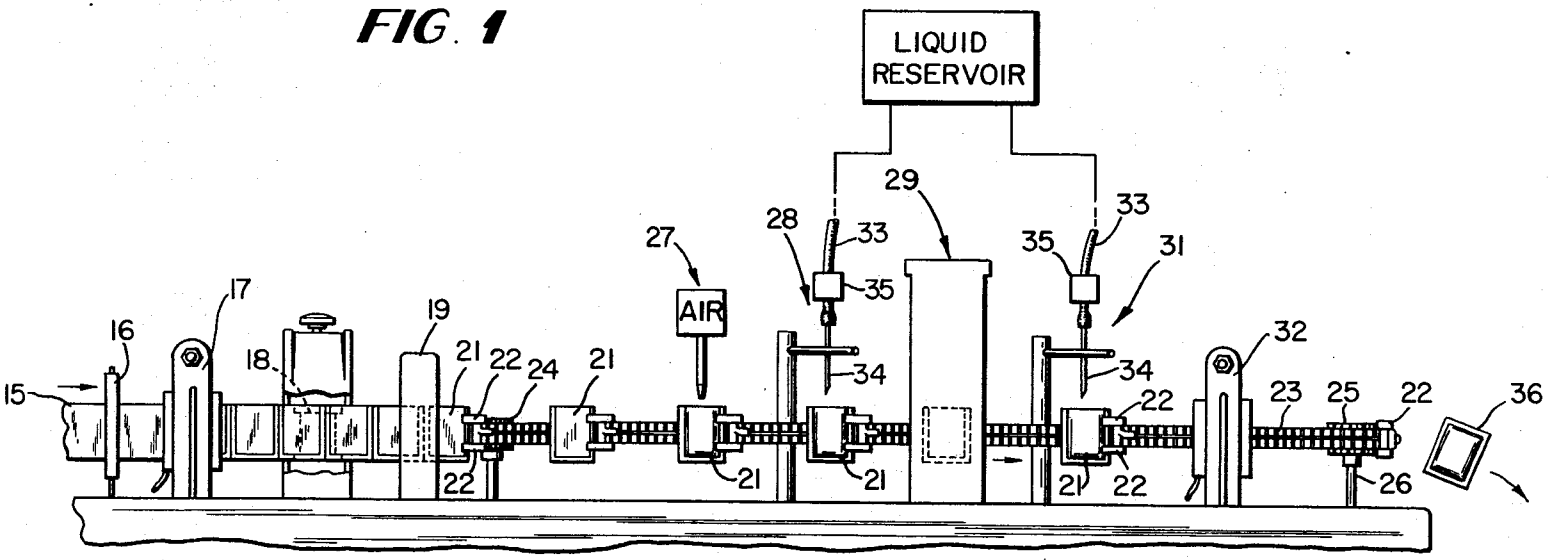
FIG. 1 illustrates somewhat diagrammatically an apparatus according to a preferred embodiment of the invention.

Referring to the drawing which illustrates part of a machine such as disclosed in said Clancy patent the numeral 15 indicates a web of laminated metal-plastic sheet material centrally folded to substantially V-shape with its open end at the top moving in the direction of the arrow between vertical guide rollers 16 into a heat seal station 17. The web is intermittently advanced by a pair of vertical axis intermittently driven feed rollers indicated at 18, and during a dwell period heat and pressure are applied at station 17 to form a bottom seal band along the folded edge and intersecting vertically extending seal bands along the web separating the web into individual envelope compartments.

After leaving the feed roll station 18 the web enters the cutting station 19 where suitable knife means (not shown) severs the web up the middle of each vertical heat seal band to thereby separate from the leading end of the web a succession of individual open top envelopes indicated at 21. Upon being severed from the web, each individual envelope while upright is grasped by spring clips 22 on an endless belt chain conveyor 23 which is mounted at opposite ends on vertical axis sprockets 24 and 25. Power is applied to a shaft 26 to intermittently drive sprocket 25 and thereby intermittently move chain 23, whereby each individual open top envelope will be advanced between operational stations to be described.

In succession each open top envelope 21 is disposed during a dwell period of the conveyor 23 at an envelope opening station 27, a premoistening station 28, a towelette insertion station 29, a balance of moisture introduction station 31 and a further heat seal station 32.

At envelope opening station 27 a blast of air under pressure is introduced into the open top of the envelope which is held by the clips 22 gripping its leading edge. This bows the envelope side walls outwardly to provide a wider top opening.

The empty opened envelope 21 now enters the premoistening station 28 upon the intermittent shift of chain 23, and there it receives an injection of the liquid that is to impregnate or otherwise moisten the towelette or pad later inserted. As shown a conduit 33 from a suitable source of the liquid under pressure such as a reservoir terminates in an injection nozzle 34 and has an automatic valve 35 controlled to open for liquid injection in timed relation with conveyor movement. The amount of liquid injected into the envelope at this point is a minor amount of the total liquid required, usually about one-fifth to one-quarter. Too much liquid should not be introduced at this station because otherwise it might interfere with full towelette insertion or cause splashing.

After obtaining the premoistening charge the envelope is moved by the next shift of chain 23 to the towelette insertion station at 29 where the pad or towelette is inserted into the open top of the envelope. Here for example a web of towelette material is longitudinally folded and cut into individual sections, and each section is thrust into an open envelope during a dwell period of the chain in timed relation with conveyor movement.

Then the envelope containing the inserted towelette, into which liquid is already absorbing by a wicking action, moves to the further liquid injection station at 31 where the balance of the required liquid is injected through a conduit 33, valve 35 and nozzle 34 as at station 28. Both conduits 33 may receive liquid from the same reservoir or, if desired, the fluid balance may be a different liquid from a different reservoir.

Now the filling action of the envelope is complete and it is moved by the chain to the final seal station at 32 where the envelope is heat sealed in a band across the open top.

The completed envelopes which move to the right in the drawing to point adjacent the sprocket 25 are there removed from the conveyor. A completed detached envelope is shown at 36, and it moves in the direction of the adjacent arrow to a carton fill station that is standard and not concerned with the invention.

The foregoing apparatus for forming the individual envelopes, transferring them to the endless chain conveyor, forming and inserting towelettes in timed succession into the envelopes, final heat sealing and removing the envelopes from the conveyor is preferably essentially the same as disclosed in said Clancy patent to which reference is made for further detail.

The provision of the two stages of liquid injection, one prior to and the other after towelette insertion, represents a novel arrangement as compared to the Clancy patent, which novel arrangement has been found to contribute to more efficient reliable packaging.

While the foregoing discloses the forming and filling of separate single envelopes, it is within the scope of the invention to form and fill two attached side by side envelopes; that is the dual envelope section that would be provided by the knife at 19 severing the web at every other vertical heat seal band. In the claims the term envelope compartment refers to the compartment of a single envelope and each compartment of a dual envelope section.

Figure 2:
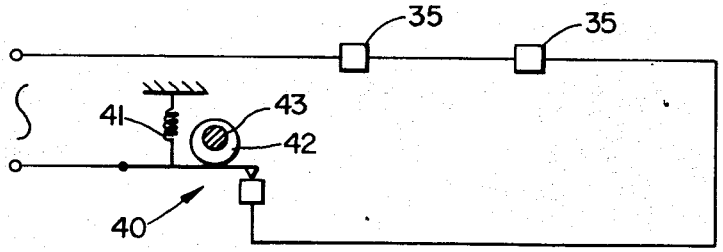
FIG. 2 is a diagrammatic view showing control of the injection stations.

FIG. 2 shows diagrammatically a preferred control for the injection of liquid at the injection stations. The valves 35 are normally closed solenoid operated valves connected in series in an electrical circuit containing a switch 40 biased open by spring 41 and periodically closed by a cam 42 on a power rotated shaft 43 in the machine. Cam 42 is so operated as to periodically close the circuit and therefore energize both solenoid valves to open condition so that spaced envelopes are simultaneous receiving their respective liquid charges during each dwell period of the conveyor 23. The valves 35 of the respective injection stations 28 and 31 are of such respective capacity as to supply the correct relative charges of liquid.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In the method of automatically making sealed compartmented packages with each compartment containing a towelette or like absorbent article moistened with a liquid in which the steps are carried out of providing a series of open top envelope compartments, stuffing each compartment with a towelette or like article, injecting a quantity of liquid therein and heat sealing the open top thereof, the improvement comprising, injecting part of the required amount of liquid into each envelope compartment, thrusting the towelette or like article into each envelope compartment, injecting the required balance of liquid into each towelette-containing envelope compartment, and then sealing the open top of each filled towelette-containing envelope compartment.

2. The method defined in claim 1, wherein only a minor portion of the required liquid is injected into the envelope compartment prior to thrusting the towelette or like article thereinto.

3. The method defined in claim 1, wherein said envelope compartments are indexed in succession at a premoistening station where said part of the required liquid is injected, and thereafter including the successive steps of moving said envelope compartments to an insertion station where the towelette or like article is thrust thereinto and to a further injection station wherein the required balance of liquid is injected.

4. In apparatus for automatically making sealed compartmented packages with each compartment containing a towelette or like absorbent article moistened with a liquid in which means are provided for positioning each of a series of open top envelope compartments in succession at an insertion station for thrusting a towelette into each successive envelope, a station for moistening it with liquid and a station for heat sealing the open top thereof, the improvement which comprises a premoistening station in advance of said insertion station, means at said premoistening station for injecting part of the required amount of liquid into each envelope compartment, means for moving said successively partially filled envelope compartments to said insertion station for thrusting the towelette or like article into each partially filled envelope compartment, and means for injecting the required balance of liquid into each partially filled towelette-containing envelope compartment prior to sealing the open top of each filled envelope compartment.

5. Apparatus as defined in claim 4, wherein said envelope compartments are intermittently moved between said stations.

6. Apparatus as defined in claim 4, including means whereby the respective amounts of liquid are injected at the same time into envelope compartments during premoistening and further injection.

7. Apparatus as defined in claim 4, wherein means is provided for moving said envelope compartments containing part of the required liquid and the towelette or like article thrust thereinto to a further injection station where the balance of the required liquid is injected.

8. Apparatus as defined in claim 7, including means whereby the respective amounts of liquid are injected at the same time into envelopes positioned at the premoistening and further injection stations.

* * * * *